United States Patent [19]

Di Nunzio et al.

[11] Patent Number: 4,958,616

[45] Date of Patent: Sep. 25, 1990

[54] MULTIPLE-SPARK IGNITION SYSTEM FOR INTERNAL COMBUSTION ENGINES, PARTICULARLY FOR MOTOR VEHICLES

[75] Inventors: Vittorio Di Nunzio; Eraldo Giaccardi, both of Turin, Italy

[73] Assignee: Fiat Auto S.p.A., Turin, Italy

[21] Appl. No.: 358,054

[22] Filed: May 30, 1989

[30] Foreign Application Priority Data

Jun. 6, 1988 [IT] Italy ..... 67520 A/88

[51] Int. Cl.[5] ..... F02P 15/02; F02P 3/04

[52] U.S. Cl. ..... 123/635; 123/638; 123/310

[58] Field of Search ..... 123/310, 634, 635, 638

[56] References Cited

U.S. PATENT DOCUMENTS

| | | | |
|---|---|---|---|
| 4,177,782 | 12/1979 | Yoshinari et al. | 123/638 |
| 4,180,031 | 12/1979 | Muranaka | 123/407 |
| 4,538,568 | 9/1985 | Fujikawa et al. | 123/638 X |
| 4,831,995 | 5/1989 | Biton | 123/635 |
| 4,834,056 | 5/1989 | Kawai | 123/635 X |
| 4,841,944 | 6/1989 | Maeda et al. | 123/634 X |

FOREIGN PATENT DOCUMENTS

| | | | |
|---|---|---|---|
| 0200196 | 4/1985 | European Pat. Off. . | |
| 0201173 | 11/1985 | European Pat. Off. . | |
| 3128827 | 4/1982 | Fed. Rep. of Germany . | |
| 2603664 | 3/1988 | France . | |
| 0093964 | 6/1983 | Japan | 123/638 |
| 0195374 | 10/1985 | Japan | 123/635 |
| 1147353 | 4/1969 | United Kingdom . | |

*Primary Examiner*—Willis R. Wolfe

*Attorney, Agent, or Firm*—Sughrue, Mion, Zinn, Macpeak & Seas

[57] ABSTRACT

The spark plugs (1*a*, 1*b*; 2*a*, 2*b*; 3*a*, 3*b*; 4*a*, 4*b*) associated with each cylinder (1, 2, 3, 4) are supplied by respective ignition coils (21, 22, 23, 24) preferably mounted on the plugs themselves.

1 Claim, 1 Drawing Sheet

MULTIPLE-SPARK IGNITION SYSTEM FOR INTERNAL COMBUSTION ENGINES, PARTICULARLY FOR MOTOR VEHICLES

BACKGROUND OF THE INVENTION

The present invention relates to ignition systems for internal combustion engines and, more particularly, is concerned with a multiple-spark ignition system (for example, with a double spark).

These systems, also known as "twin-spark" systems, are used to an ever-increasing extent in equipping sports cars.

DESCRIPTION OF THE PRIOR ART

The ignition systems used until now in twin-spark engines are of conventional electrical and electronic type.

By way of reference, two twin-spark ignition systems of known type will now be described with reference to FIGS. 1 and 2 of the appended drawings.

In general, and also in the description of the invention which follows, reference will be made to systems intended to be applied to four-cylinder engines. These systems thus operate with four pairs of spark plugs 1, 2, 3, 4, each associated with one of the cylinders and including two plugs indicated by the suffices a and b respectively.

The system illustrated in FIG. 1 corresponds in practice to the duplication of two ordinary single-spark ignition systems.

The high-tension ignition signal generated by two ignition transformers 5*a*, 5*b* (of which the part relating to the piloting of the primary, of electronic or mechanical type, is not illustrated here) is fed to respective distributors 6*a*, 6*b* which supply the individual plugs.

As already stated, two ignition systems are thus present, of which the first (5*a*, 6*a*) supplies the plugs 1*a*, 2*a*, 3*a*, 4*a* and the second (5*b*, 6*b*) supplies the plugs 1*b*, 2*b*, 3*b* and 4*b*.

FIG. 4 illustrates two graphs, indicated B), showing the generation of the ignition pulses by the two transformers or coils 5*a* and 5*b*; this must occur at every rotation of the engine shaft through 180°, in synchronism with the ignition sequence in the various cylinders 1, 2, 3, 4, as also illustrated in the graph A) in the same FIG. 4.

In order to store the energy necessary for generating the spark, therefore, the primary of each coil 5*a*, 5*b* must pass current each 180° of the engine.

The power dissipated by the Joule effect is:

$P_{J1}=i_{eff1}^2\times R_{P1}$ where $i_{eff1}$ = effective primary winding current $R_{p1}$ = primary winding resistance.

At the instant when the primary current is cut off, the stored energy is transferred to the secondary and conducted to the plugs 1*a*...4*b* through:

the high-tension coil-distributor leads (7*a*, 7*b*), the distributors (6*a*, 6*b*), and the distributor-plug high-tension leads, generally indicated 8*a* and 8*b*.

The energy losses between the secondary winding and the plugs can in this case be evaluated as about 50÷60% of which about 40% is through just the distributor (6*a*, 6*b*).

The striking of the arc between the electrodes of the plug occurs when there is a sufficiently high voltage difference between them. The high tension is generated across the ends of the secondary of the coil at the instant when the primary current is cut off and, other conditions being equal, the higher the impedance seen by the secondary, the higher will be the high-tension available.

The determinations made by the Applicant on a specific coil in relation to the system of FIG. 1 indicates that this tension usually reaches a maximum value slightly greater than 20 kV (negative or positive relative to earth) within about 60-80 microseconds.

The system shown schematically in FIG. 2 applies the so-called "lost-spark" principle. In this case, four transformers or coils 9, 10, 11, 12 are present, each of which supplies a respective pair of plugs associated with different cylinders. In the embodiment illustrated here, the coil 9 supplies the plugs 1*a* and 4*a*, the coil 10 the plugs 2*b* and 3*a*, the coil 11 the plugs 2*a* and 3*b*, and the coil 12 the remaining plugs 1*b* and 4*b*.

The part relating to the piloting of the primaries of the coils, not shown in the drawing, will always be of the electronic type.

Supposing now that ignition is effected through the coils 9 and 12: a spark will be generated both in the plugs of the cylinder 1 and in those of the cylinder 4. If it is also supposed that the cylinder 1 is in the compression stage and the cylinder 4 is in the exhaust stage, only the spark in the plugs 1*a*, 1*b* of the cylinder 1 will cause ignition of the mixture, while the spark in the plugs of the cylinder 4 will have no effect as regards combustion and will thus be "lost".

The same is true for the coils 10 and 11.

In the superposed graphs, generally indicated (C) in FIG. 4, which illustrate the generation of the ignition signals by the coils 9, 10, 11 and 12 with reference to the ignition sequence of graph A, it is seen that each coil passes a current at every 360° rotation of the engine shaft.

The Joule power dissipated relative to the previous example will be $P_{J2}=P_{J1}/2$ (assuming that the parameters of the coils are all the same).

The energy losses between the secondary winding and the plug of the cylinder under compression are almost equal to those of the system of FIG. 1. Only 40÷50% of the energy available to the secondary is transferred to the active plug.

In this case, the determinations made by the Applicant, again with reference to the same physical and dimensional parameters as considered previously, in the case in which cylinder 1 is under compression and cylinder 4 is in exhaust, with a negative discharge polarity on the plugs for the cylinder 1 and a positive polarity for the cylinder 4 and with the arc-sparking tension on the plug of the cylinder 4 (which is lower than that of the cylinder 1 in that it is in exhaust) of about 5 kV, show that the tensions across the secondary of the coil may reach a value of the order of about 25 kV.

OBJECT AND SUMMARY OF THE INVENTION

The present invention thus aims to provide a multiple-spark ignition system which is improved over the prior art both as regards a better efficiency of the transfer of the ignition energy to the spark plugs and as regards the increase in the ignition tension available.

According to the present invention, this object is achieved by an ignition system for internal combustion engines, in which at least one cylinder of the engine has an associated plurality of spark plugs, and including at least one energizing source which supplies a respective combination of spark plugs, characterised in that all the plugs of the respective combination are associated with a respective cylinder of the engine.

BRIEF DESCRIPTION OF THE DRAWINGS

The invention will now be described, purely by way of non-limiting example, with reference to the appended drawings, in which.

DETAILED DESCRIPTION OF THE INVENTION

Figure 3:
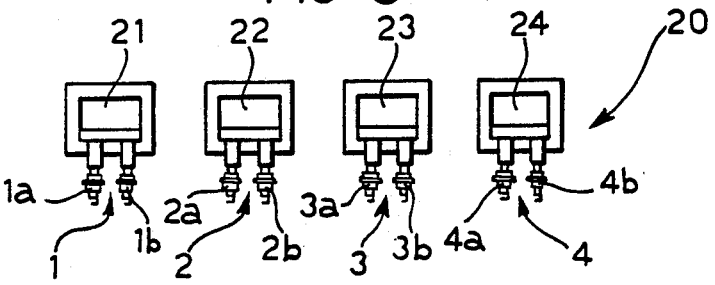
FIG. 3 illustrates schematically the structure of an ignition system according to the invention, and FIGS. 4, A–D combine a plurality of superposed time graphs indicative of the operating criteria of the systems of FIGS. 1 to 3.

In FIG. 3, a twin-spark ignition system is generally indicated 20 and includes four ignition transformers (or coils) 21, 22, 23 and 24 with respective associated supply circuits for the primary, not illustrated here since it is of known type.

Figure 2:
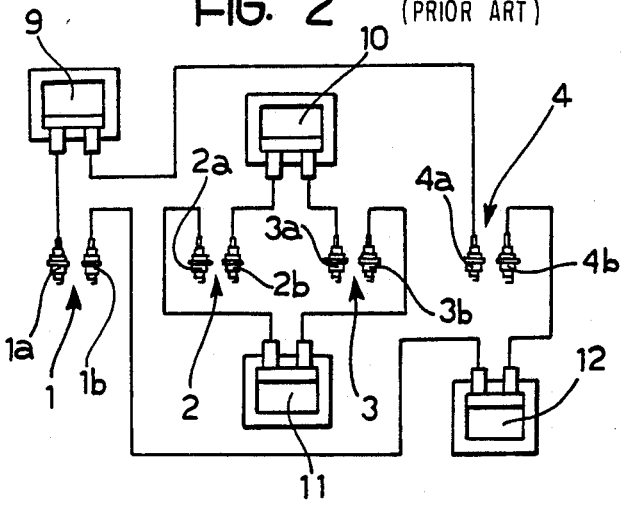
FIG. 2 (PRIOR ART)

As in the case of the system of FIG. 2, each coil 21, 22, 23, 24 supplies a pair of plugs both associated with the same cylinder of the engine.

More precisely, in the embodiment illustrated, the coil 21 supplies the plugs 1*a* and 1*b*, the coil 22 the plugs 2*a* and 2*b*, the coil 23 the plugs 3*a*, 3*b*, and finally the coil 24 the plugs 4*a* and 4*b*.

Figure 1:
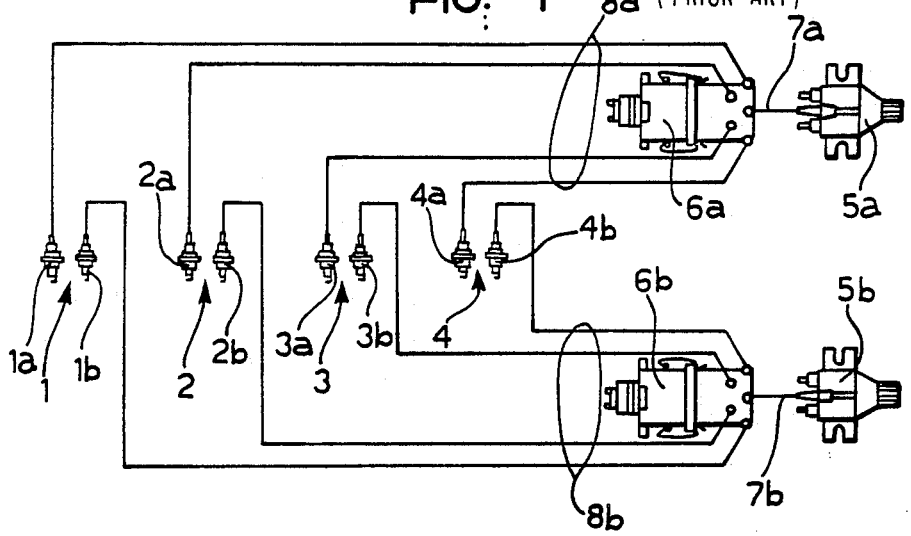
FIG. 1 (PRIOR ART)
FIGS. 1 and 2 relate to the prior art and have already been described above.

In this case, as illustrated in the graphs generally indicated (D) in FIG. 4, the generation of the ignition signal by each coil may occur at each 720° of rotation of the engine shaft, that is, at a frequency equal respectively to a quarter and a half of the frequencies used in the prior-art systems illustrated in FIGS. 1 and 2.

For this type of application, moreover, the coils 21–24 could have a smaller weight and bulk than the coils 9–12 used in the lost-spark static ignition system of FIG. 2 (considered from now on by way of comparison), while ensuring the high tension and energy needed for correct ignition.

By way of reference, it should be noted that the power dissipated by the Joule effect $P_{J2}$ (FIG. 2) and $P_{J3}$ (FIG. 3) will be respectively:

$P_{J2}=R_{p2}\times i_{eff2}^2$ in the system of FIG. 2, and $P_{J3}=R_{p3}\times i_{eff3}^2$ in the system of FIG. 3 where $R_{p2}$ and $R_{p3}$ represent the resistances of the primary of the coils and $i_{eff2}$ and $i_{eff3}$ the effective values of the currents which pass through them.

FIG. 4, this will be:

$$i_{eff3} = \frac{ieff2}{\sqrt{2}} \text{ whereby}$$

$$P_{J3} = R_{p3} \times \frac{ieff2^2}{2}$$

For the same length of the winding of the primary $R_{p2}=R_{p3}$ and hence $$P_{J3}=1/2\ P_{J2}$$

When it is wished to dissipate the same power to the two coils, it will then be:

$P_{J2}=P_{J3}$ and this gives:

$$R_{p2}\, i_{eff2}^2 = R_{p3}\frac{ieff^2 2}{2} \text{ from which:}$$

$$R_{p2} = \frac{R_{p3}}{2}$$

Consequently, the resistivity of the material (usually copper) of the winding being indicated $\rho$, the sections of the winding in the two cases being indicated $S_2$ and $S_3$ respectively, and the length of the wire being L, this gives:

$$\rho\frac{1}{S_2} = \frac{1}{2}\cdot\rho\cdot\frac{1}{S_3}$$

and the same length of wire, this gives:

$$S_3 = \frac{S_2}{2}$$

with the consequent possibility of reducing the radius of the winding by a factor of ½ in the case of the system of FIG. 3.

The section occupied by the primary winding in the windows of the core may thus be reduced by about 30%.

Similar considerations may be made regarding the loss in the secondary winding. The Joule losses are reduced by 50% for these as well and, if practical criteria did not militate against falling below a certain diameter of wire (about 6/100 mm), the same percentage reduction could also be achieved in the dimensioning of the latter as can be achieved for the primary. In the system according to the invention, however, the advantage remains for the secondary in that the Joule losses not recovered by the reduction in the copper result in a smaller rise in the working temperature of the winding itself. This is useful in that, in a preferred embodiment of the invention, it allows the coil to be mounted directly on the two plugs supplied, where the temperature is rather high.

Consequently, in the hypothetical case in which the section of the iron of the coils 21–24 is kept constant, the area of the windows which receive the windings could be reduced with a consequent reduction both in the volume and weight of the iron necessary, as well as in the weight of copper already indicated.

Whenever it is wished to reduce the iron of the core rather than the copper, one could follow the concept of keeping the section of the wire constant and increasing the number of turns, reducing the section of the magnetic core proportionally.

The quantity of energy stored in the primary is the same in both the systems of FIGS. 2 and 3 taken in comparison with the case in which neither the primary inductance nor the current I which passes through it are variable. In the system of FIG. 3, with each coil 21–24 mounted directly on the two plugs supplied by it, there are no transmission losses or such losses are very limited. All the energy present in the secondary will thus be transferred and divided in approximately equal parts between the plugs of the cylinder in compression.

It may thus be stated that the quantity of energy available for good combustion in the system of the invention is at least equal if not actually superior to that of the lost-spark system of FIG. 2.

Since the two plugs supplied by each coil 21–24 are in the same cylinder in compression, the tension needed to initiate the discharge should be equal for both.

In practice, it will be understood that, because of lack of homogeneity in the medium, gap differences, or differences in the electrodes, the spark will always be struck first on one plug and then on the other. The determinations carried out by the Applicant on the system of FIG. 3 in conditions substantially like those to which reference has been made above for the lost-spark system of FIG. 2 show that, in the case of the system according to the invention, which uses the same coils as those in FIG. 2, the high tension available at the second plug is 30 kV and is thus much greater than that of the lost-spark system.

To summarise, the system according to the invention provides, relative to the system of FIG. 2 (and with even more reason with respect to the system of FIG. 1) for:

coils of smaller bulk and loss;

elimination of all the high-tension leads and the losses associated therewith;

spark energy and high tension at the plugs which are the same or even greater for the same energy stored in the primary and for the same coil-turn ratio.

A further advantage of the invention lies in the fact that, at the instant when the first gap is penetrated (that is, at the initiation of the spark at the first plug of each pair), a tension pulse is delivered to the second plug, improving the operation of the plugs when they are dirty.

It is in fact known that the dirt on the plug corresponds to a resistor placed in parallel with the gap and having a value which is smaller the greater the amount of dirt.

Hence, in the hypothetical case in which one plug is more dirty than the other (statistically it is very improbable that the two plugs of each cylinder will be equally dirty at the same time) and thus one branch resistance is less than the other, for reasons explained above, the discharge will occur first on the one in the better state (which has a bigger R) and then on the one in the worse state.

The high tension present at the latter has the impulsive component which tends to improve the operation of the plug itself.

What is claim:

1. An ignition system for an internal combustion engine having at least one cylinder, a pair of ignition plugs associated with each cylinder and a single compact energizing means associated with each pair of ignition plugs and mounted directly on each pair of ignition plugs respectively in direct electrical contact therewith to provide transmission of ignition energy directly from each energizing means to each pair of ignition plugs respectively, substantially without any transmission loss;

wherein each energizing means comprises electrical transformer means having a secondary winding connected to each pair of ignition plugs respectively.

* * * * *